US006113438A

United States Patent [19]

O'Sullivan

[11] Patent Number: 6,113,438

[45] Date of Patent: Sep. 5, 2000

[54] ELECTRICAL CONNECTOR AND METHOD OF ASSEMBLING SAME

[75] Inventor: Michael O'Sullivan, Willowbrook, Ill.

[73] Assignee: Molex Incorporated, Lisle, Ill.

[21] Appl. No.: 09/334,289

[22] Filed: Jun. 16, 1999

[51] Int. Cl.[7] ..... H01R 13/42

[52] U.S. Cl. ..... 439/740; 439/885

[58] Field of Search ..... 439/740, 733.1, 439/885, 752, 444, 607; 29/747

[56] References Cited

U.S. PATENT DOCUMENTS

| | | | |
|---|---|---|---|
| 4,045,868 | 9/1977 | Ammon et al. | 29/629 |
| 4,164,065 | 8/1979 | Funcik et al. | 29/564 |
| 4,442,594 | 4/1984 | Narozny | 29/884 |
| 4,589,585 | 5/1986 | Long, Jr. | 228/119 |
| 4,740,180 | 4/1988 | Harwath et al. | 439/856 |
| 4,744,771 | 5/1988 | Uchida | 439/374 |
| 4,826,453 | 5/1989 | Glomb et al. | 439/595 |
| 4,870,753 | 10/1989 | Pfeffer et al. | 29/884 |
| 5,060,372 | 10/1991 | Capp et al. | 29/883 |
| 5,064,391 | 11/1991 | Buchter | 439/733 |
| 5,286,218 | 2/1994 | Sakurai et al. | 439/444 |
| 5,320,549 | 6/1994 | Schempp et al. | 439/246 |
| 5,558,206 | 9/1996 | Maejima et al. | 29/845 |
| 5,692,928 | 12/1997 | Nelson et al. | 439/733 |
| 5,807,142 | 9/1998 | O'Sullivan | 439/733 |
| 5,820,417 | 10/1998 | Yamada | 439/686 |
| 5,931,707 | 8/1999 | Ito | 439/752 |

*Primary Examiner*—Lincoln Donovan
*Assistant Examiner*—Chandrika Prasad
*Attorney, Agent, or Firm*—Charles S. Cohen; Robert J. Zeitler

[57] ABSTRACT

A plurality of terminals are assembled into a housing of an electrical connector. The terminals initially are joined by a carrier strip. The housing has a plurality of terminal-receiving passages along with an insertion slot communicating with and spanning a plurality of the passages. The terminals are inserted into the insertion slot in an insertion direction. The terminals and carrier strip are moved transversely of the insertion direction. The terminals and carrier strip may be moved again generally parallel to the insertion direction until the terminals are positioned in the terminal-receiving passages. The carrier strip is removed from the terminals after the terminals are seated into their passages.

35 Claims, 12 Drawing Sheets

ELECTRICAL CONNECTOR AND METHOD OF ASSEMBLING SAME

FIELD OF THE INVENTION

This invention generally relates to the art of electrical connectors, including a method of assembling a plurality of terminals into a connector housing.

BACKGROUND OF THE INVENTION

Generally, a typical electrical connector includes some form of dielectric or insulating housing mounting a plurality of conductive terminals. For instance, the housing may be molded of plastic material and the terminals may be stamped and formed of sheet metal material. The housing has terminal-receiving passages into which the terminals are inserted so that contact portions of the terminals are exposed for engaging the contact portions of the terminals of a complementary mating connector or other connecting device.

A typical electrical connector has a front mating end or face at which the contact portions of the terminals are exposed, and a rear terminating end or face at which terminating portions of the terminals are located. The terminal-receiving passages extend generally between the mating and terminating ends of the connector housing. In assembling such electrical connectors, the terminals can be inserted into the passages either from the rear end of the housing or from the front end of the housing.

When terminals are inserted into the terminal-receiving passages from the rear terminating end of the connector housing, problems have been encountered with the terminals having a tendency to back out of the housing in response to mating forces on the terminals at the front mating end of the connector. Often, a second housing component is utilized in order to counteract this tendency. However, this adds both material and manufacturing costs to the assembly.

When terminals may have been inserted into their passages from the front mating end of the connector housing, different problems have been encountered. Depending on the spacing or pitch of the terminals, an adequate surface may not exist to push the terminals into their passages. Further, if the front or contact portion of the terminals is utilized for pushing, extra care must be exercised in order to avoid damaging or misaligning the contact portion of the terminals.

The present invention is directed to a unique method of gang loading a plurality of terminals into a connector housing while the terminals are joined by a carrier strip.

SUMMARY OF THE INVENTION

An object, therefore, of the invention is to provide a new and improved electrical connector in which terminals are gang loaded into the connector housing.

Another object of the invention is to provide a unique method of assembling a plurality of terminals into a housing of an electrical connector.

The invention contemplates that the terminals initially are joined by a carrier strip. The housing has a plurality of terminal-receiving passages.

In the exemplary embodiment of the invention, the housing is provided with a slot communicating with and spanning a plurality of the terminal-receiving passages. The terminals are inserted into the slot in an insertion direction while the carrier strip is still attached. The terminals and carrier strip then are moved transversely of the insertion direction until the terminals are positioned in the terminal-receiving passages.

The invention contemplates moving the terminals in the insertion direction to seat the terminals in the terminal-receiving passages after the terminals are moved transversely of the insertion direction into the passages. The terminals are moved in the insertion direction until abutment shoulders on the terminals engage abutment surfaces on the housing. The carrier strip then can be removed from the terminals.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
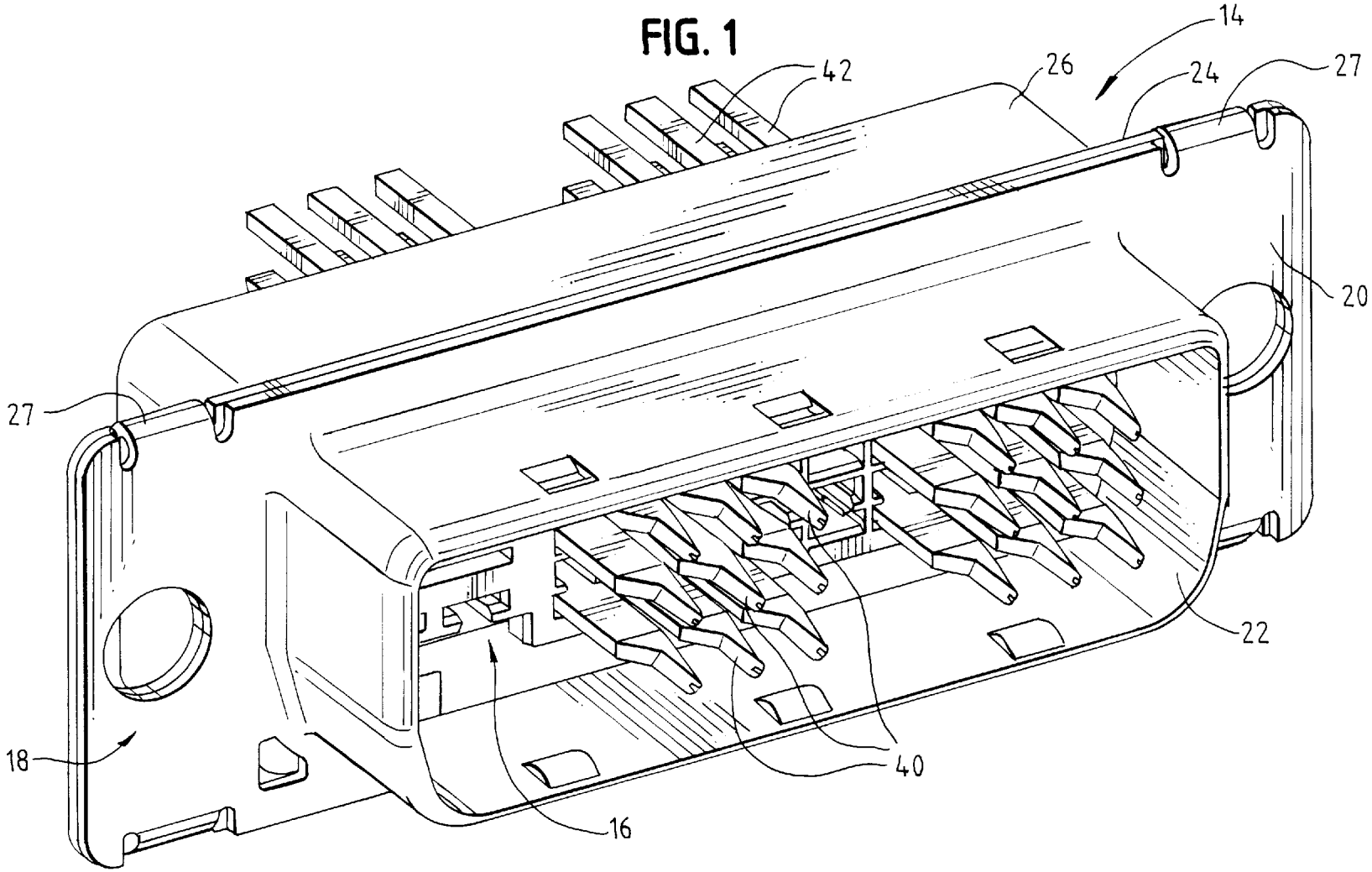
FIG. 1 is a front perspective view of an electrical connector having terminals assembled according to the invention with certain terminals removed for clarity.
Figure 2:
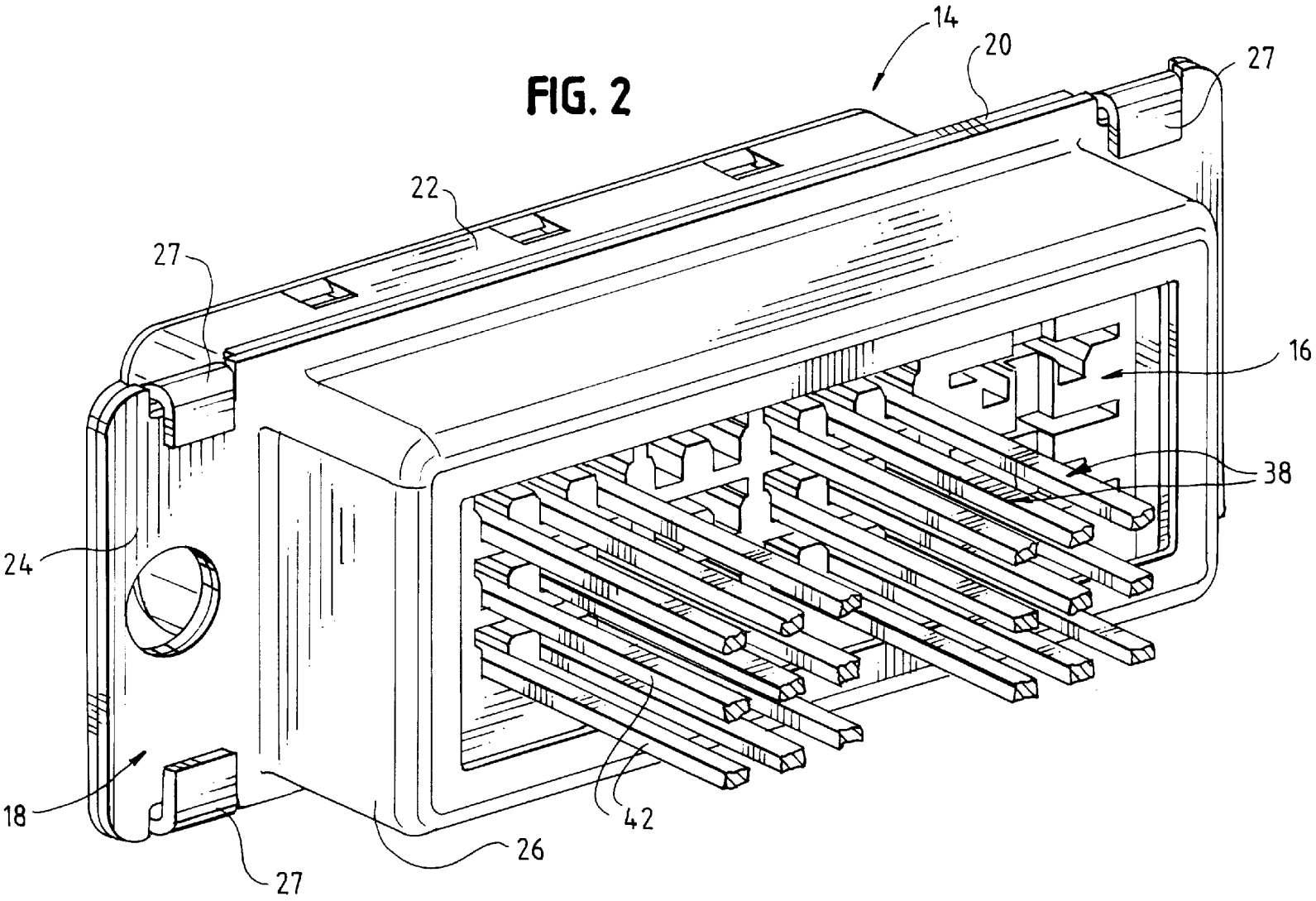
FIG. 2 is a rear perspective view of the connector of FIG. 1.
Figure 3:
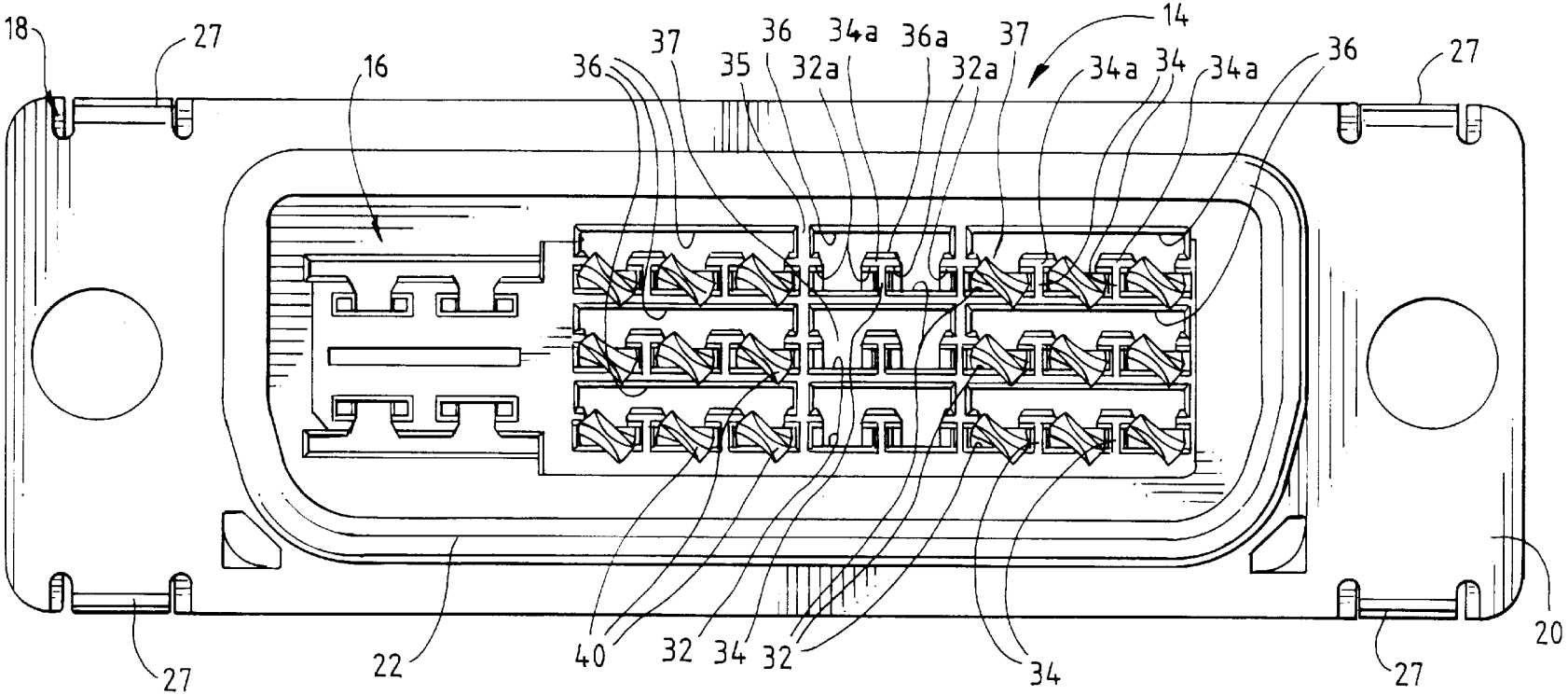
FIG. 3 is a front elevational view of the connector of FIG. 1.

Referring to the drawings in greater detail, and first to FIGS. 1–3, the invention is embodied in an electrical connector, generally designated 14. The connector is a shielded connector and includes a dielectric housing, generally designated 16, substantially surrounded by a shield, generally designated 18. The shield includes a front part defined by a flange 20 and a forwardly projecting shroud 22, and a rear part defined by a flange 24 and a rearwardly projecting shroud 26. Flanges 20 and 24 of the front and rear shield parts are juxtaposed against each other and clamped together by tabs 27 projecting rearwardly from flange 20 and bent behind flange 24 as best seen in FIG. 2. Rearwardly projecting shroud 26 of the rear shield part substantially surrounds housing 16, and forwardly projecting shroud 22 of the front shield part defines a front mating receptacle of the connector and surrounds the contact portions of the terminals as described below.

Figure 4:
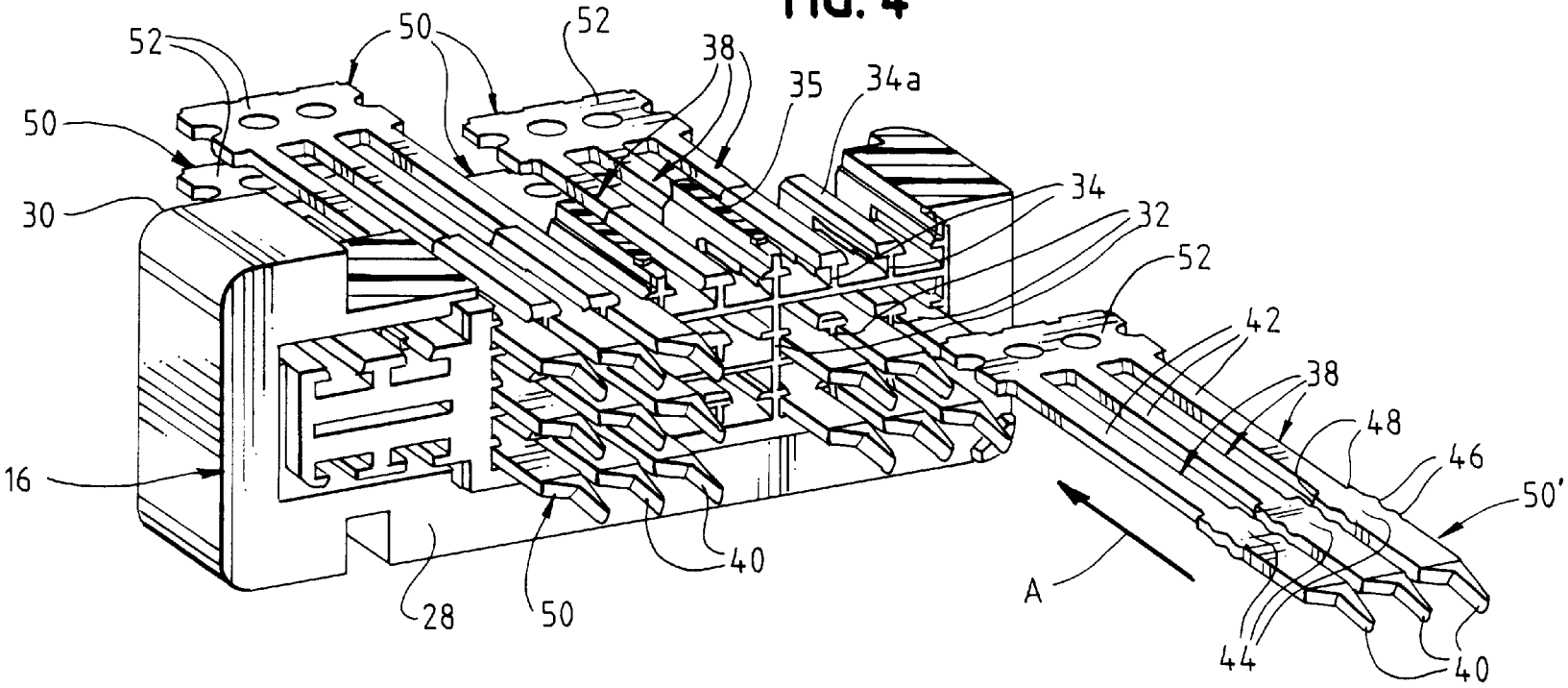
FIG. 4 is a horizontal cut-away perspective view of the connector housing with one of the terminal clusters yet to be inserted in the housing.

In particular, referring to FIG. 4 in conjunction with FIGS. 1–3, dielectric housing 16 is a one-piece structure unitarily molded of plastic material. The housing includes a front mating face 28 and a rear terminating face 30. A plurality of terminal-receiving passages 32 extend through the housing between the front and rear faces. The passages include a relatively wide forward section 32*w* and a relatively narrow rearward section 32*n* (FIG. 12) and are separated by partitions 34. As best seen in FIG. 3, a plurality of insertion slots 36 communicate with and span the terminal-receiving passages 32. These insertion slots are horizontally separated in a single plane by ribs 35. FIG. 3 shows that two of the insertion slots 36 communicate with and span three terminal-receiving passages 32 while a central insertion slot 36 communicates with and spans two terminal-receiving passages 32. Partitions 34 have upper ribs 34*a* that define an upper edge 32*a* of the terminal receiving passage 32 and a lower edge 36*a* of the insertion slot 36.

Still referring to FIGS. 1–4, connector 14 includes a plurality of stamped and formed sheet metal terminals, generally designated 38 (FIG. 4), which are assembled into housing 16 so that the terminals are mounted in terminal-receiving passages 32. Each terminal includes a front contact portion 40 and a rear terminating portion 42. Each terminal also includes a retention section 44 having outwardly directed teeth or barbs 46. The retention sections form rearwardly projecting abutment shoulders 48 at opposite sides of the terminals.

Terminals 38 are stamped and formed from sheet metal into terminal clusters, generally designated 50, comprised of a plurality of terminals joined by a carrier strip 52. In the embodiment shown, the clusters have three terminals although different numbers could be utilized. The carrier strip is sized for insertion into one of the insertion slots 36 (FIG. 3) extending through housing 16 between front mating face 28 and rear terminating face 30 thereof. In the embodiment shown, the two outer columns of terminal-receiving passages 32 include three passages 22 communicating with each insertion slot 36, corresponding to three terminals 38 in the cluster 50. The central column of terminal receiving passages 32 includes two passages 32 communicating with each invention slot 36. As such, it can be seen that the invention is not limited to "gang loading" of terminal clusters of three terminals. Greater or fewer terminals can be employed in each cluster, with insertion slots 36 dimensioned accordingly to receive the length of the carrier strip 52.

Figure 5:
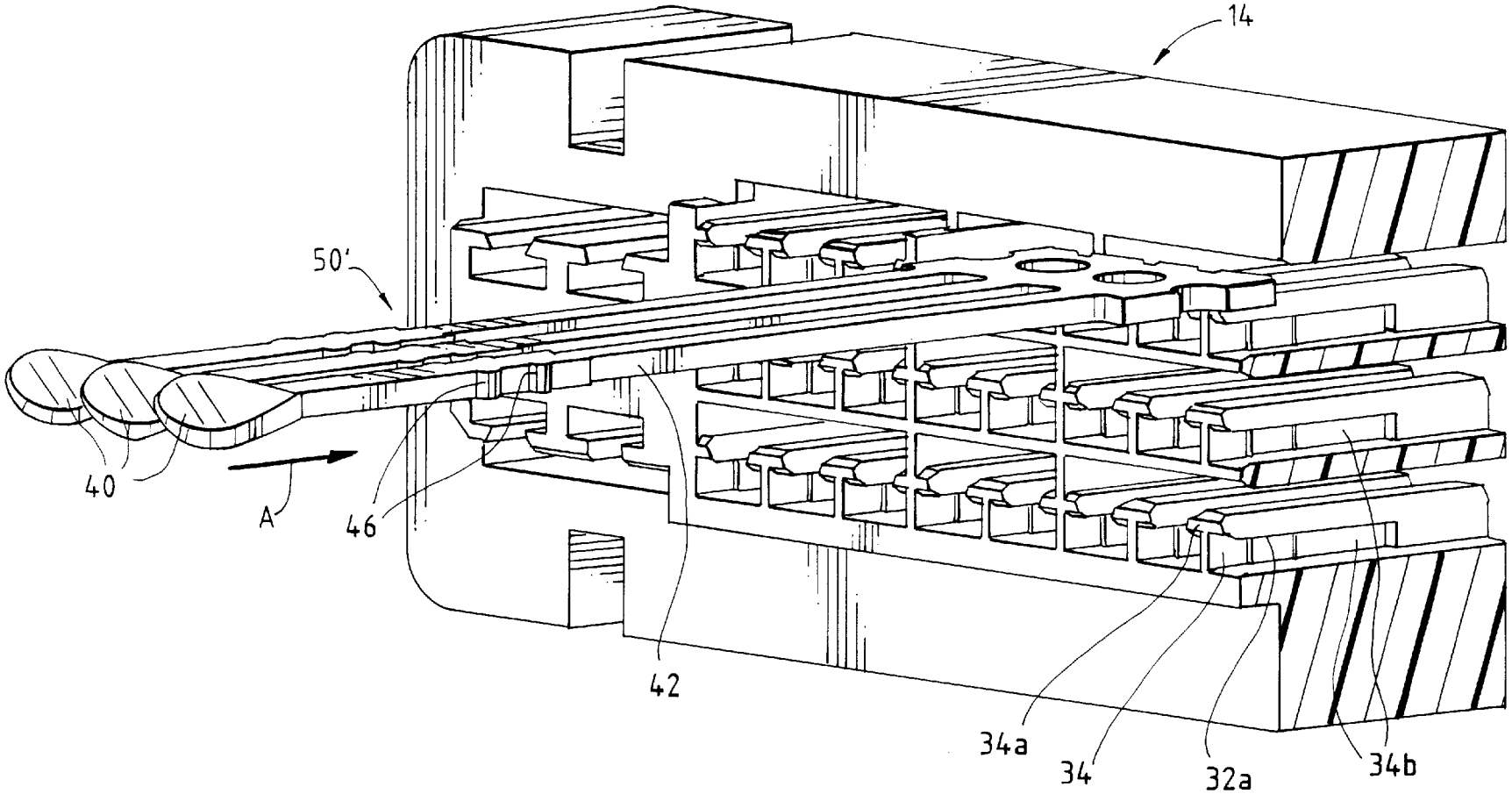
FIG. 5 is a vertical cut-away perspective view of the connector housing with only one of the terminal clusters about to be inserted into the housing.

FIGS. 4–11 show the steps involved in assembling terminals 38 into terminal-receiving passages 32 of dielectric housing 16 of connector 12. Turning first to FIGS. 4 and 5, it can be seen that five terminal clusters 50 of three terminals 38 already have been mounted in housing 16. One terminal cluster 50' is about to be inserted into the housing in the direction of arrow "A" which represents the "insertion direction" of the terminals.

Figure 6:
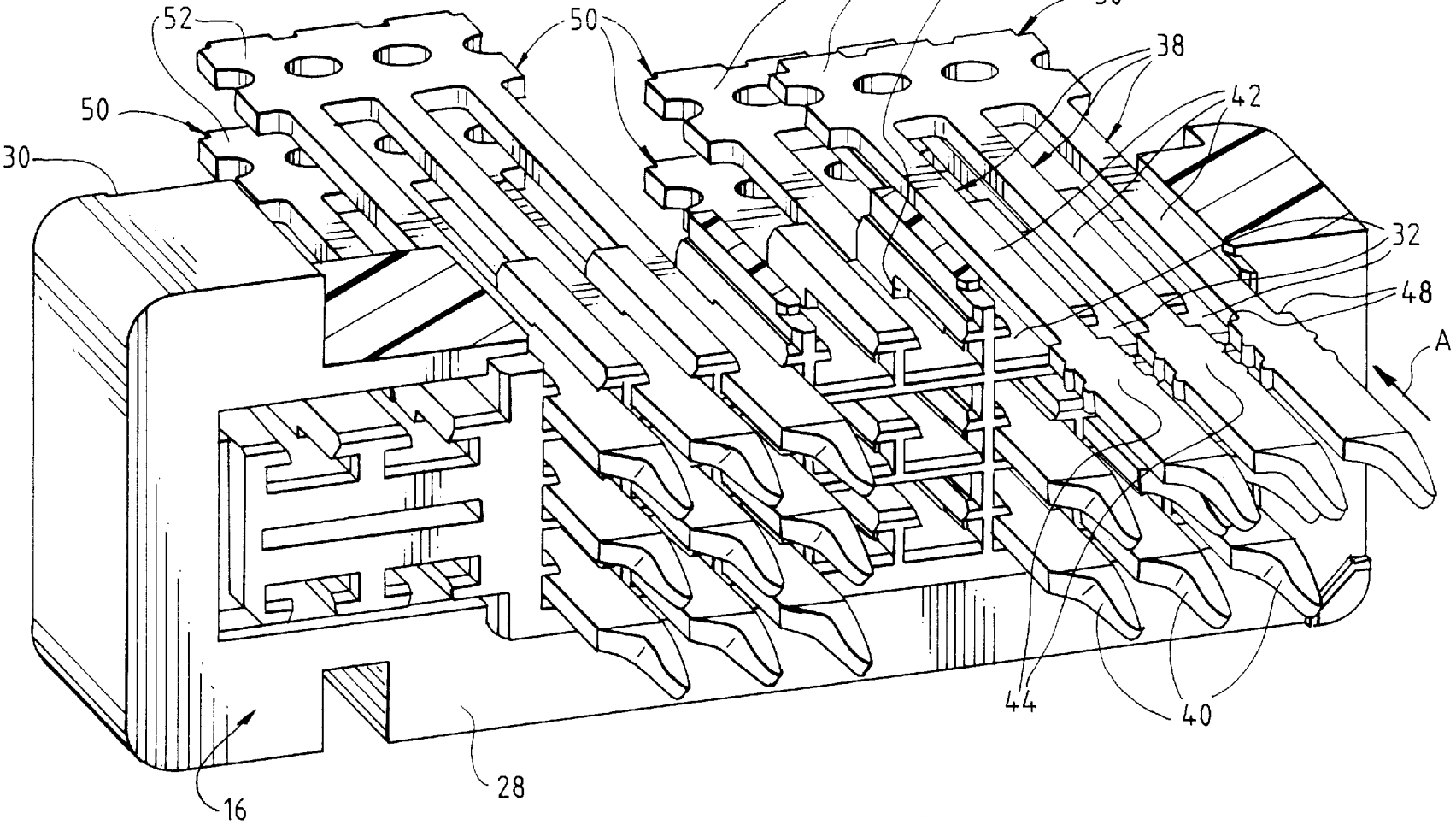
FIG. 6 is a view similar to that of FIG. 4 with the carrier strip of the terminal cluster inserted through one of the insertion slots in the housing.
Figure 7:
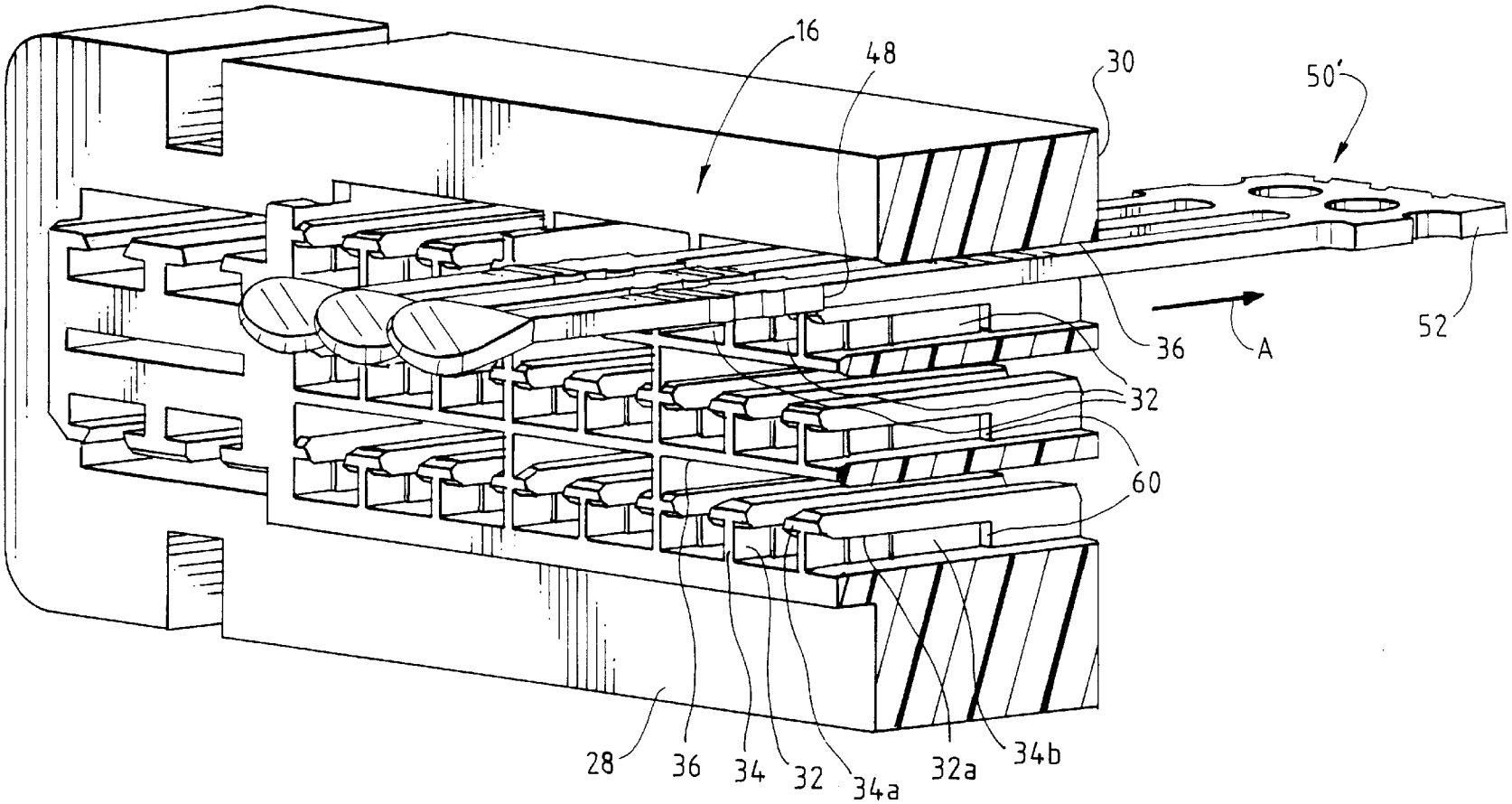
FIG. 7 is a view similar to that of FIG. 5 with the carrier strip of the terminal cluster inserted through one of the insertion slots in the housing.

FIGS. 6 and 7 show the one terminal cluster 50' having been inserted in insertion direction "A" so that terminals 38 are aligned with terminal-receiving passages 32 and carrier strip 52 moves through insertion slot 36 as best seen in FIG. 7, until the carrier strip is located beyond rear terminating face 30 of housing 16. It is significant to note in FIG. 6 that: (a) terminals 38 of the cluster 50' are located above terminal-receiving passages 32 and within insertion slot 36; and (b) the terminal cluster 50' has not been inserted rearwardly as far as the five other terminal clusters already mounted in the housing.

Figure 8:
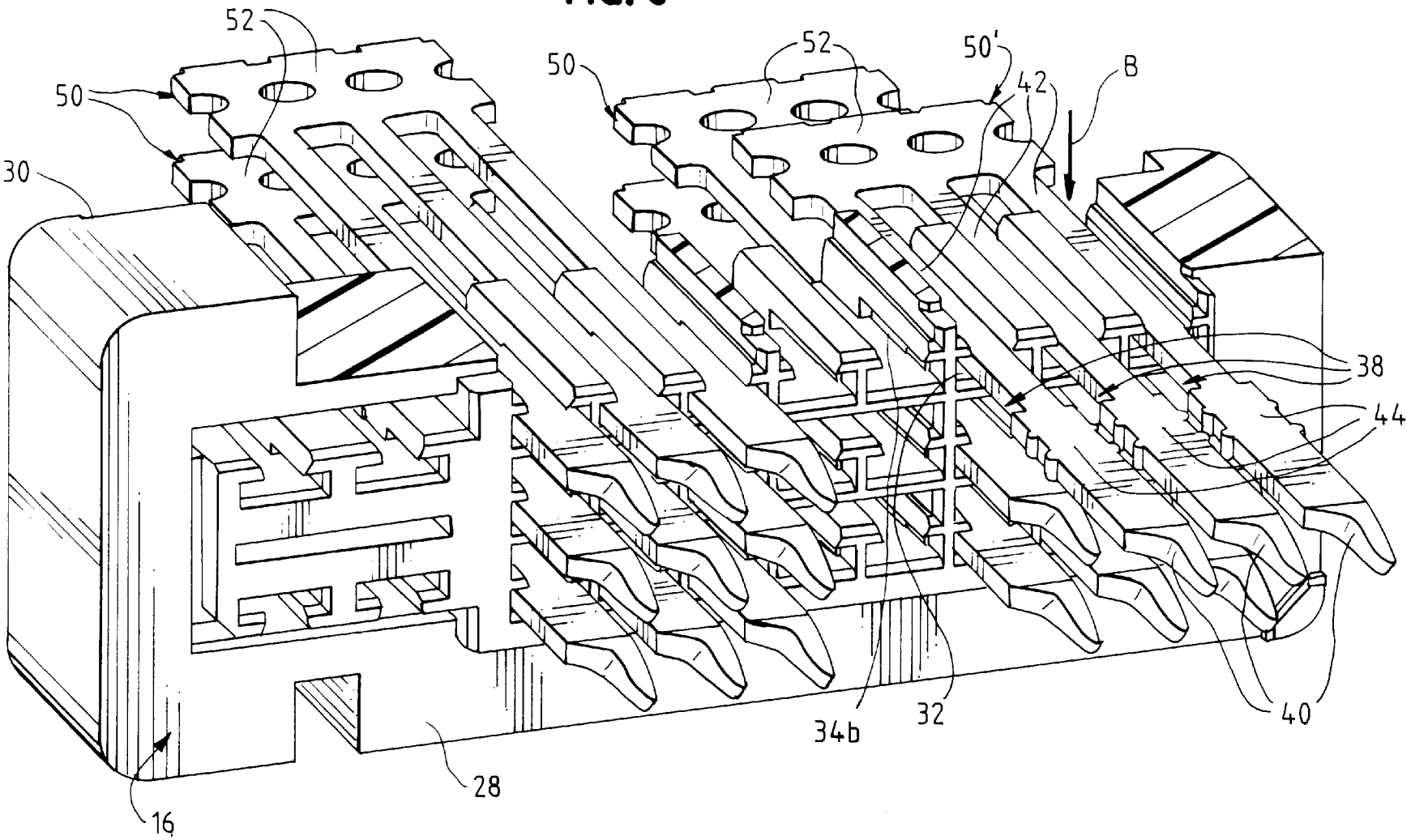
FIG. 8 is a view similar to that of FIG. 6 with the terminal cluster moved transversely of the insertion direction until the terminals are positioned in the terminal receiving passages.
Figure 9:
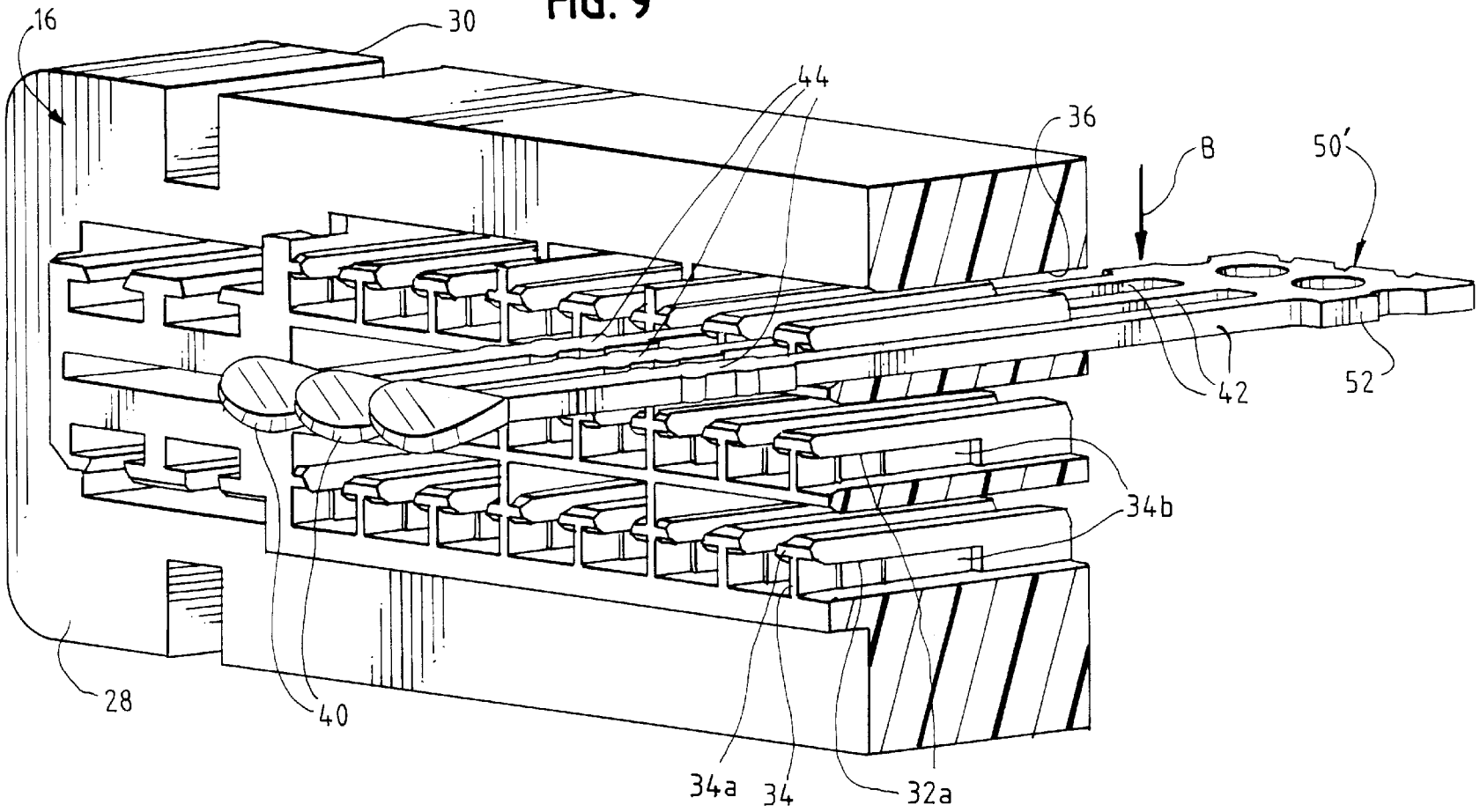
FIG. 9 is a view similar to that of FIG. 7 with the terminal cluster moved transversely of the insertion direction until the terminals are positioned in the terminal receiving passages.

FIGS. 8 and 9 show the terminal cluster 50' having been moved in a direction indicated by arrows "B" which is down or transverse to insertion direction "A" (FIGS. 6 and 7). When the terminal cluster 50' is moved downwardly in the direction of arrows "B," terminals 38 (particularly rear terminating portions 42) drop from insertion slot 36 through transition area 37 and past upper ribs 34*a* into terminal-receiving passages 32.

Figure 10:
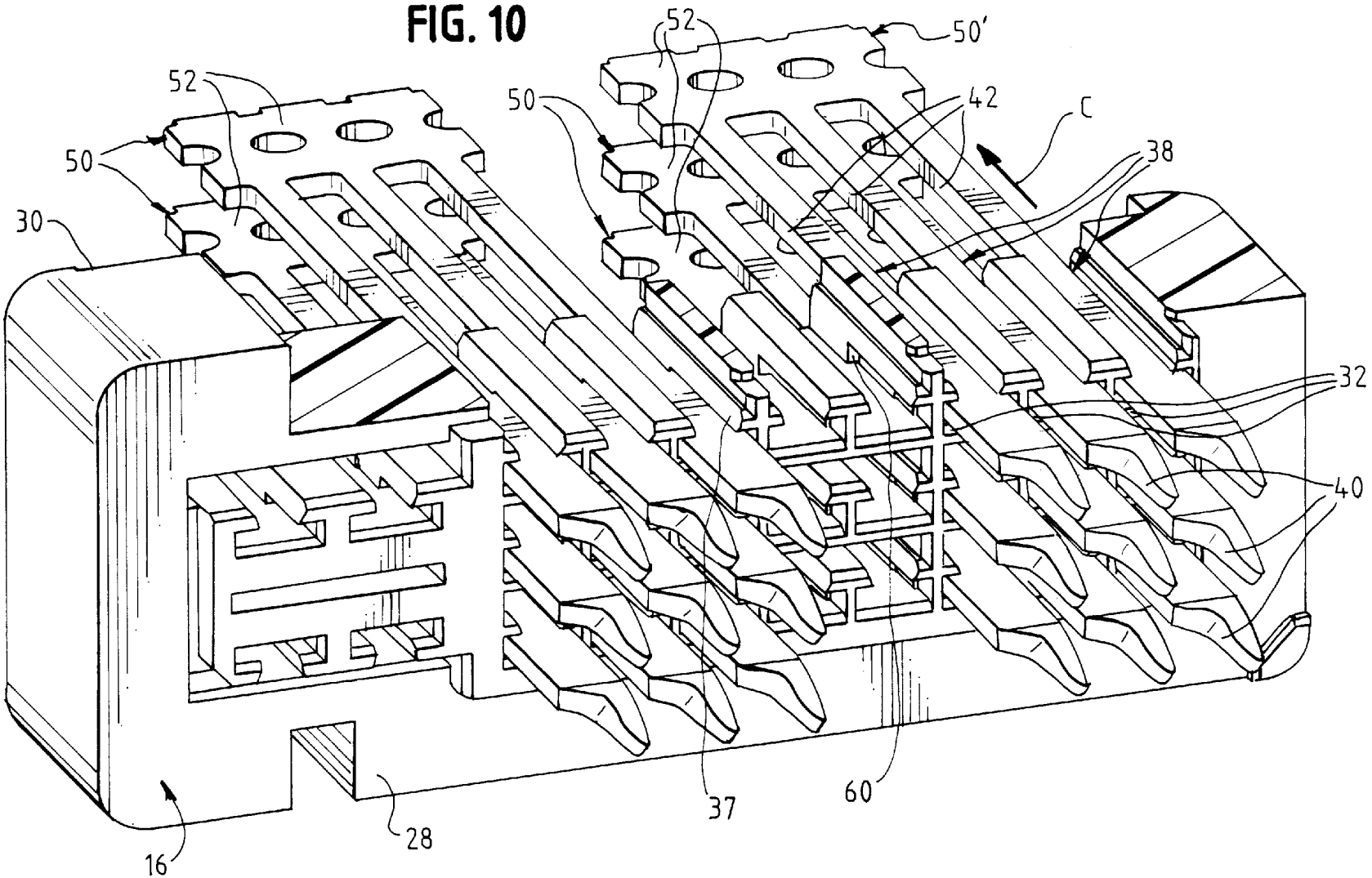
FIG. 10 is a view similar to that of FIG. 8 with the terminal cluster being moved rearwardly in the insertion direction to its final position.
Figure 11:
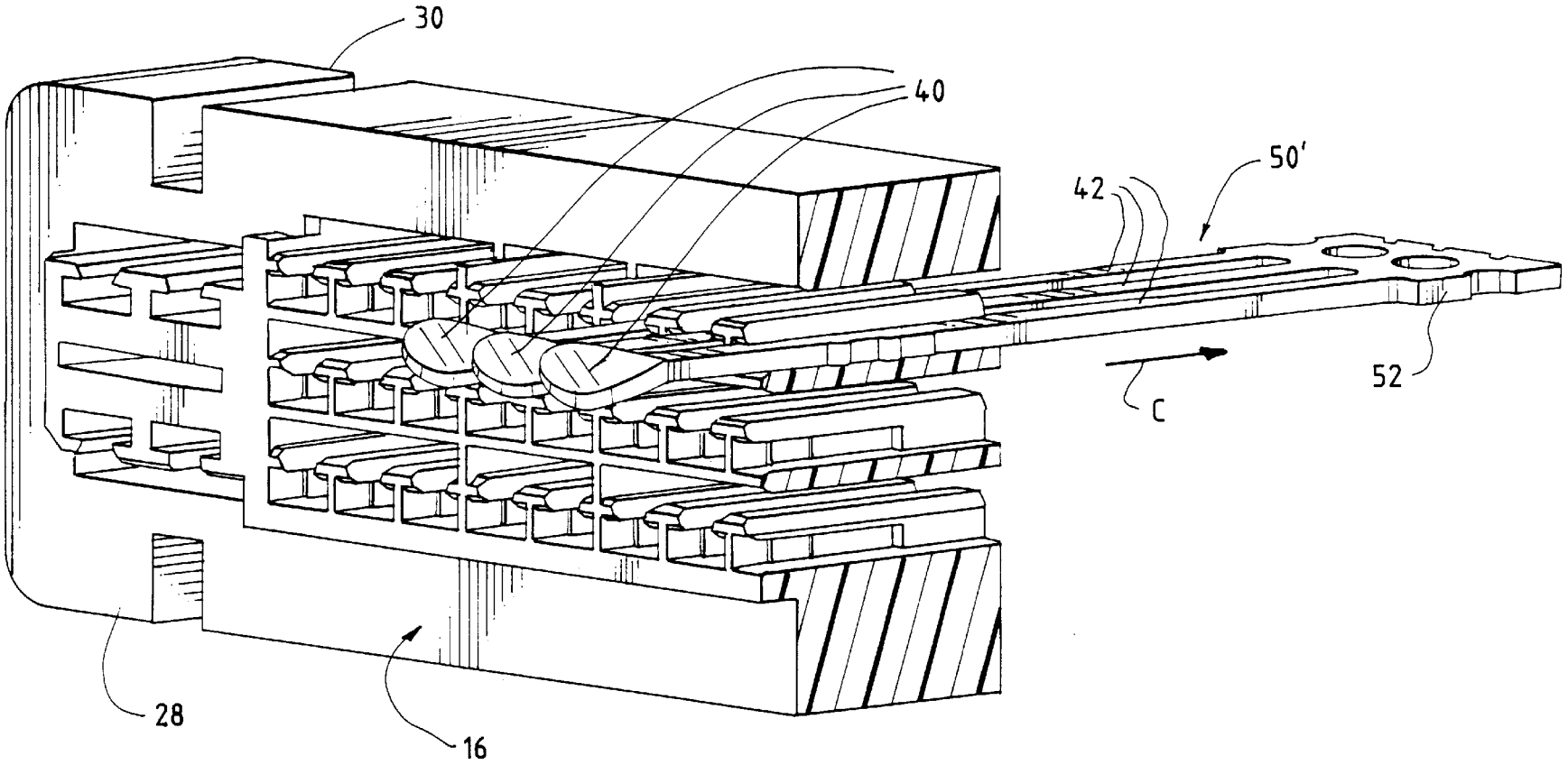
FIG. 11 is a view similar to that of FIG. 9 with the terminal cluster being moved rearwardly in the insertion direction to its final position.
Figure 12:
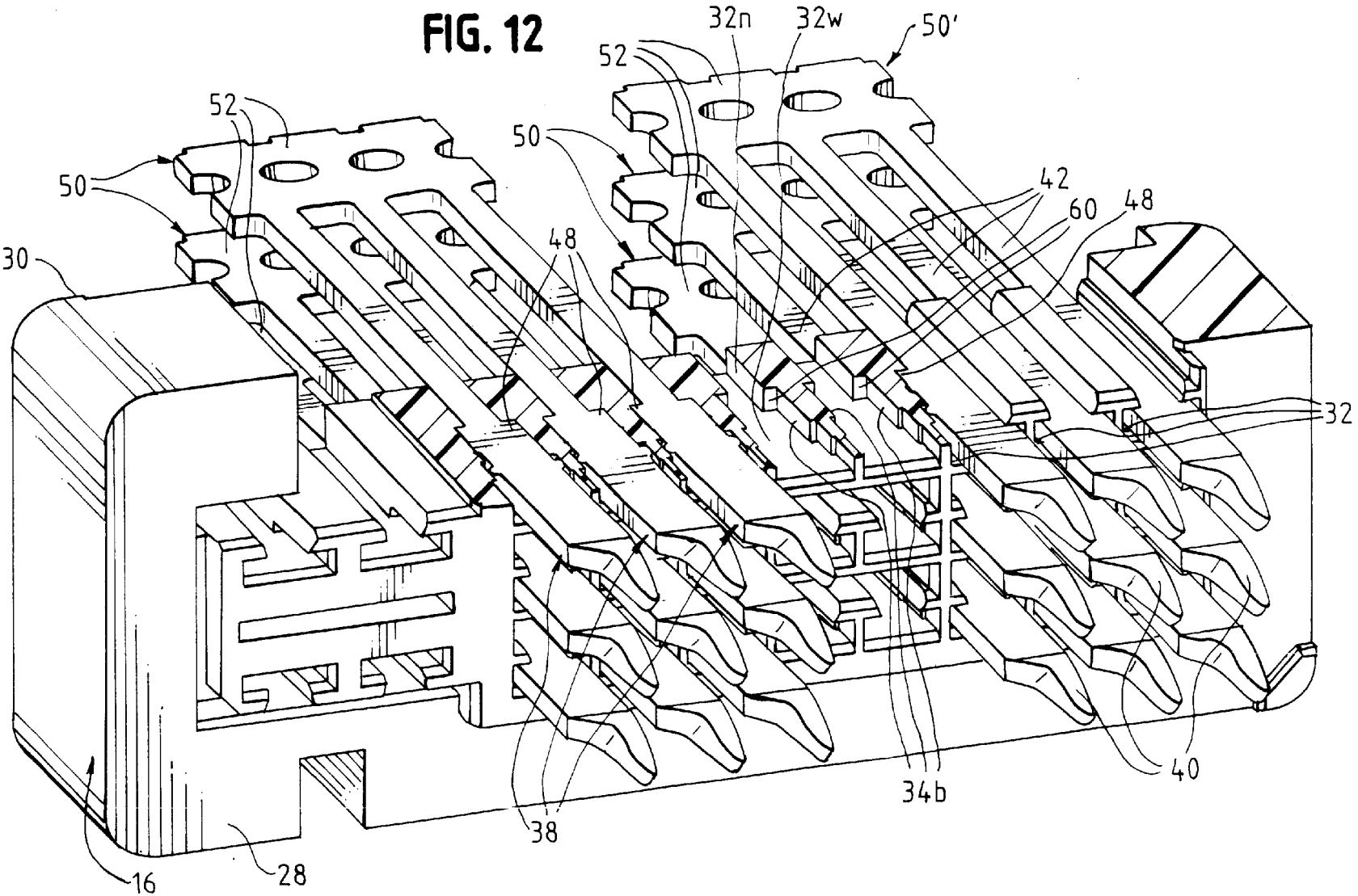
FIG. 12 is a view similar to that of FIG. 10 but with the housing further cut-away to show the abutment surfaces between the terminals and the housing.

FIGS. 10 and 11 show the terminal cluster 50' having been moved rearwardly in the direction of arrows "C" which is generally parallel to the insertion direction of the terminal cluster. During the movement of the terminals in the direction of arrow C, the barbs 46 dig into the partitions 34 at an area 34*b* in which the distance between adjacent partitions is slightly less than the distance across retention section 44 and barbs 46 of terminal 38. Movement of the terminals 38 in the direction of arrow "C" ceases when rearwardly projecting abutment shoulders 48 contact and engage the abutment shoulders or surfaces 60 formed on partitions 34 within terminal-receiving passages 32. The abutment surfaces 60 face forwardly for engaging the rearwardly facing abutment surfaces 48 of terminals 38. The terminals therefore cannot back out of the housing in response to mating forces on front contact portions 40 of the terminals. In FIG. 12, all of the terminals of all of the terminal clusters shown are fully seated within terminal-receiving passages 32 in housing 16. The retention sections 44 of the terminals are located in the forward section 32*w* of terminal receiving passages 32 and the terminating portions 42 of the terminals extend through the rearward section 32*n* of the terminal receiving passages. The only remaining step is to remove carrier strips 52 from terminating portions 42, leaving all of the terminals 38 as separate and individual components. Wires or cables then can be attached to the rear terminating portions 42. The rear terminating portions of the terminals also can be formed into various configurations, if desired, such as forming the connector as a right angled connector, with the rear terminating portions forming terminal tails for insertion into appropriate holes in a printed circuit board or a surface mount application in which the rear terminating portions form terminal tails for contacting conductive pads on a printed circuit board.

It will be understood that the invention may be embodied in other specific forms without departing from the spirit or central characteristics thereof. For example, by modifying the terminal insertion slots and terminal-receiving passages, the terminals could be inserted from the rear face of the housing. The terminals would be slid into the insertion slot, dropped down and then slid back for final seating. Another alternative could utilize tails that are on a different plane compared to the contact and retention sections. In such embodiment, the contact and retention sections would enter the insertion slots and the terminals dropped down before the tails enter the insertion slot in the housing. As such, a portion of the housing would initially act as part of the insertion slot and subsequently function as a portion of the terminal-receiving cavities. The present examples and embodiments, therefore, are to be considered in all respects as illustrative and not restrictive, and the invention is not to be limited to the details given herein.

I claim:

1. An electrical connector, comprising:

a dielectric housing having a mating face, a terminating face, a plurality of stepped terminal-receiving passages extending between the faces and defining an insertion direction, each terminal-receiving passage being configured to receive a terminal therein and having an enlarged section and a narrowed section, said enlarged section being closer to said mating face than said narrowed section, a rearward portion of said enlarged section having a forwardly facing abutment shoulder for engaging a complementary abutment shoulder on a terminal inserted in the terminal-receiving passage, a terminal insertion slot in at least one of said faces spanning the plurality of terminal-receiving passages in a direction transverse to said insertion direction and being adjacent said plurality of terminal receiving passages; and a plurality of electrically conductive terminals secured within the terminal-receiving passages of the housing, each said terminal having a contact section for engaging a mating electrical component, a tail section for interconnection to an electrical circuit member, a retention section for securing the terminal in its respective terminal-receiving passage, and an abutment shoulder engaging said forwardly facing abutment shoulder in its respective terminal-receiving passage.

2. The electrical connector of claim 1 wherein said housing is a unitarily molded, one-piece member.

3. The electrical connector of claim 1 wherein said housing further includes a transition region between each said terminal receiving passage and said insertion slot, and said tail section of each terminal is dimensioned so that a portion thereof passes through said transition region to permit passage of said terminal from said slot to said terminal receiving passage.

4. The electrical connector of claim 1 wherein said retention section of each terminal is wider than the tail section of the terminal, said retention section being located within said enlarged section of the housing and the tail section being located within said narrowed section of the housing.

5. The electrical connector of claim 3 wherein said retention section of each terminal is wider than the tail section of the terminal, said retention section being located within said enlarged section of the housing and the tail section being located within said narrowed section of the housing.

6. The electrical connector of claim 5 wherein said retention section is secured within said housing immediately adjacent said transition region.

7. The electrical connector of claim 3 wherein said retention section is secured within said housing immediately adjacent said transition region.

8. The electrical connector of claim 1 wherein said terminals are made from sheet metal material having a predetermined thickness, said insertion slot is at least as tall as the thickness of the sheet metal material of the terminals, and the transition region is at least as wide as the narrowest portion of the terminals.

9. The electrical connector of claim 1 wherein said housing includes a plurality of partitions between the terminal-receiving passages and separating the terminals, the partitions having spaced apart upper ribs separating said passages from said insertion slot, said transition region being located between a pair of said spaced apart ribs.

10. The electrical connector of claim 1 wherein said housing includes a plurality of said insertion slots and adjacent terminal-receiving passages.

11. The electrical connector of claim 10 where said plurality of insertion slots are in a vertically spaced apart array.

12. An electrical connector, comprising:

a dielectric housing having a front mating face, a rear terminating face, a plurality of stepped terminal-receiving passages extending between the faces, and a terminal insertion slot communicating with and spanning the plurality of terminal-receiving passages; and a plurality of electrically conductive terminals secured within the terminal-receiving passages of the housing, each said terminal having a contact section for engaging a mating electrical component, a tail section for interconnection to an electrical circuit member, and a retention section for securing the terminal in its respective terminal-receiving passage;

said slot being dimensioned to receive said plurality of terminals therein and each said terminal-receiving passage being dimensioned to receive only one terminal therein.

13. The electrical connector of claim 12 wherein said housing is a unitarily molded, one-piece member.

14. The electrical connector of claim 12 wherein each said terminal-receiving passage has a forwardly facing abutment shoulder for engaging a complementary abutment shoulder on a terminal inserted in the terminal-receiving passage and each said terminal having an abutment shoulder engaging said forwardly facing abutment shoulder in its respective terminal-receiving passage.

15. The electrical connector of claim 12 wherein said terminal insertion slot extends through one of said front mating face and a rear terminating face.

16. The electrical connector of claim 12 wherein said housing further includes a transition region between each said terminal receiving passage and said terminal insertion slot, and said tail section of each terminal is dimensioned so that a portion thereof passes through said transition region to permit passage of said terminal from said slot to said terminal receiving passage.

17. The electrical connector of claim 16 wherein said retention section of each terminal is wider than the tail section of the terminal.

18. The electrical connector of claim 16 wherein said retention section is secured within said housing immediately adjacent said transition region.

19. The electrical connector of claim 12 wherein said terminals are made from sheet metal material having a predetermined thickness, said insertion slot is at least as tall as the thickness of the sheet metal material of the terminals, and the transition region is at least as wide as the narrowest portion of the terminals.

20. The electrical connector of claim 12 wherein said housing includes a plurality of partitions between the terminal-receiving passages and separating the terminals, the partitions having spaced apart upper ribs separating said passages from said terminal insertion slot, said transition region being located between a pair of said spaced apart ribs.

21. The electrical connector of claim 12 wherein said housing includes a plurality of said insertion slots and adjacent terminal-receiving passages.

22. A housing for an electrical connector, comprising:

a unitarily molded, one-piece dielectric body;

a front mating face;

a rear terminating face;

a plurality of stepped terminal-receiving passages extending between the faces, each said terminal-receiving passage being configured to receive a terminal therein and having a forwardly facing abutment shoulder for engaging a complementary abutment shoulder on a terminal inserted in the terminal-receiving passage;

a terminal insertion slot extending through one of said faces, said terminal insertion slot communicating with and spanning the plurality of terminal-receiving passages; and a plurality of partitions between the terminal-receiving passages, the partitions having spaced apart upper ribs separating said passages from said insertion slot, whereby a plurality of terminals joined by a carrier strip can be inserted into the housing by inserting the carrier strip first into the slot and then moving the terminals transversely into the passages.

23. The housing of claim 22 wherein each terminal-receiving passage has an enlarged section and a narrowed section, said enlarged section being closer to said mating face than said narrowed section, a rearward portion of said enlarged section having said forwardly facing abutment shoulder therein.

24. The housing of claim 22 further including a plurality of said insertion slots and adjacent terminal-receiving passages.

25. A method of assembling a plurality of terminals into a housing of an electrical connector, comprising the steps of:

providing a housing having a front mating face, a rear terminating face and a plurality of terminal-receiving passages extending in a direction between the faces, and a terminal insertion slot, the insertion slot communicating with and spanning a plurality of the terminal-receiving passages;

providing a plurality of electrically conductive terminals joined by a carrier strip;

inserting the plurality of terminals into said insertion slot in an insertion direction;

moving the terminals and carrier strip transversely of said insertion direction until the terminals are positioned in the terminal-receiving passages;

moving the terminals parallel to said insertion direction to seat the terminals in the terminal-receiving passages after the terminals are moved transversely of the insertion direction into the passages; and removing the carrier strip from the terminals.

26. The method of claim 25 wherein the terminals are moved in said seating movement until abutment shoulders on the terminals engage abutment surfaces on the housing.

27. The method of claim 25 wherein said terminals are inserted into said housing by inserting the carrier strip first into said slot, and said carrier strip is removed with the carrier strip located beyond the rear terminating face outside the housing.

28. The method of claim 25 wherein each said terminal has a tail section for interconnection to an electrical circuit member, said housing includes a plurality of partitions between the terminal-receiving passages, the partitions having spaced apart upper ribs separating said passages from said terminal insertion slot and defining a transition region located between a pair of said spaced apart ribs, and said transverse movement step includes moving said terminal tail section through said transition region from said insertion slot to said terminal-receiving passage.

29. The method of claim 28 wherein said terminal further includes a retention section for securing the terminal in its respective terminal-receiving passage, and said seating movement step includes moving said retention section of said terminal under said upper ribs.

30. A method of assembling a plurality of terminals into a housing of an electrical connector, comprising the steps of:

providing the housing having a plurality of terminal-receiving passages and a terminal insertion slot communicating with and spanning a plurality of the terminal-receiving passages;

providing a plurality of electrically conductive terminals joined by a carrier strip;

inserting the terminals into the terminal insertion slot in an insertion direction;

moving the terminals and carrier strip transversely of said insertion direction until the terminals are positioned in the terminal-receiving passages; and removing the carrier strip from the terminals.

31. The method of claim 30 wherein said housing is provided with a front mating face and a rear terminating face with said insertion slot extending through one of said faces, and the carrier strip is inserted into the slot at the front mating end of the housing until the carrier strip is located beyond the rear terminating end outside the housing.

32. The method of claim 31 including a further step of moving the terminals parallel to said insertion direction until abutment shoulders on the terminals engage abutment surfaces on the terminal-receiving passages in order to seat the terminals in the terminal-receiving passages.

33. The method of claim 30 wherein said terminals are inserted into said housing by inserting the carrier strip first into said slot, and said carrier strip is removed with the carrier strip located beyond the rear terminating face outside the housing.

34. The method of claim 30 wherein each said terminal has a section of reduced width, said housing includes a plurality of partitions between the terminal-receiving passages, the partitions having spaced apart upper ribs separating said passages from said terminal insertion slot and defining a transition region located between a pair of said spaced apart ribs, and said transverse movement step includes moving said section of reduced width through said transition region from said insertion slot to said terminal-receiving passage.

35. The method of claim 34 wherein said terminal further includes a retention section for securing the terminal in its respective terminal-receiving passage, and said seating movement step includes moving said retention section of said terminal under said upper ribs.

* * * * *